US007938709B2

(12) United States Patent
Leonov

(10) Patent No.: US 7,938,709 B2
(45) Date of Patent: May 10, 2011

(54) STEERING MECHANISM FOR A TOY VEHICLE

(76) Inventor: Vladimir Leonov, Mesa, AZ (US)

( * ) Notice: Subject to any disclaimer, the term of this patent is extended or adjusted under 35 U.S.C. 154(b) by 236 days.

(21) Appl. No.: 12/146,682

(22) Filed: Jun. 26, 2008

(65) Prior Publication Data

US 2009/0325460 A1 Dec. 31, 2009

(51) Int. Cl.
*A63H 17/36* (2006.01)

(52) U.S. Cl. ..... 446/468; 446/129; 446/448; 446/454; 446/460

(58) Field of Classification Search ..... 446/454, 446/460, 465, 468
See application file for complete search history.

(56) References Cited

U.S. PATENT DOCUMENTS

| | | | | |
|---|---|---|---|---|
| 796,893 | A | 8/1905 | Brennan | |
| 2,182,385 | A | 12/1939 | Neracher et al. | |
| 3,083,499 | A | 4/1963 | Balthazor | |
| 3,474,564 | A | 10/1969 | Perryman | |
| 3,574,969 | A | 4/1971 | Cleveland et al. | |
| 3,614,686 | A | 10/1971 | Ellis | |
| 3,705,387 | A | 12/1972 | Stern et al. | |
| 4,034,504 | A | 7/1977 | Sudo | |
| 4,135,328 | A | 1/1979 | Yamasaki | |
| 4,163,341 | A | 8/1979 | Jones et al. | |
| 4,296,852 | A | 10/1981 | Luerken | |
| 4,411,100 | A | 10/1983 | Suimon | |
| 4,471,566 | A * | 9/1984 | Ishimoto | 446/129 |
| 4,571,213 | A * | 2/1986 | Ishimoto | 446/468 |
| 4,743,214 | A | 5/1988 | Tai-Cheng | |
| 4,767,376 | A | 8/1988 | Hanzawa et al. | |
| 4,816,795 | A * | 3/1989 | Suto | 335/272 |
| 4,881,917 | A * | 11/1989 | Suzuki et al. | 446/468 |
| 4,896,899 | A | 1/1990 | Lawrence | |
| 4,898,562 | A * | 2/1990 | Ishimoto | 446/460 |
| 5,014,841 | A | 5/1991 | Gillespie | |
| 5,158,495 | A | 10/1992 | Yonezawa | |
| 5,261,853 | A | 11/1993 | Suto | |
| 5,281,184 | A | 1/1994 | Suimon | |
| 5,709,583 | A | 1/1998 | Suto et al. | |
| 5,851,134 | A * | 12/1998 | Chiu | 446/468 |

(Continued)

FOREIGN PATENT DOCUMENTS

DE 3151952 7/1983

(Continued)

*Primary Examiner* — Alvin A Hunter
*Assistant Examiner* — Scott Young
(74) *Attorney, Agent, or Firm* — Panitch Schwarze Belisario & Nadel LLP

(57) ABSTRACT

A toy vehicle has a chassis with road wheels movement including one or two each mounted to pivot about a general vertical axis to steer. A steering mechanism includes a turning member mounted so as to pivot about the generally vertical axis and supporting one road wheel for rotation about a horizontal axis for movement of the vehicle and about the generally vertical axis to steer the vehicle. A control member slides across the chassis. A magnetic body pivots on a pivot axis extending front and rear. The magnetic body has a central axis perpendicular to the pivot axis with opposite magnetic poles of the body locate along the central axis on opposite sides of the pivot axis. A crank is connected at one end with the magnetic body and at an opposite end with the elongated opening of the control member. A coil surrounds the magnetic body and rotates the magnetic body by the passage of an electric current in a selected direction through the coil thereby pivoting each road wheel connected with the control member.

14 Claims, 7 Drawing Sheets

U.S. PATENT DOCUMENTS

| | | | | |
|---|---|---|---|---|
| 5,879,131 | A | 3/1999 | Arlton et al. | |
| 6,095,081 | A | 8/2000 | Gochenour | |
| 6,095,891 | A | 8/2000 | Hoeting et al. | |
| 6,170,354 | B1 * | 1/2001 | Lee | 74/496 |
| 6,170,596 | B1 | 1/2001 | Triarsi et al. | |
| 6,250,449 | B1 | 6/2001 | Haussner | |
| 6,315,630 | B1 | 11/2001 | Yamasaki | |
| 6,349,786 | B1 | 2/2002 | Gift | |
| 6,350,173 | B1 | 2/2002 | Tsang | |
| 6,482,069 | B1 | 11/2002 | Tilbor et al. | |
| 6,616,501 | B2 | 9/2003 | Spalinski | |
| 6,656,011 | B2 | 12/2003 | Yoneda | |
| 6,692,333 | B2 | 2/2004 | Kislevitz et al. | |
| 6,726,523 | B2 | 4/2004 | Baker et al. | |
| 6,827,627 | B2 | 12/2004 | Tsang | |
| 6,971,942 | B2 | 12/2005 | Baker et al. | |
| 6,997,774 | B2 * | 2/2006 | Kaneko et al. | 446/466 |
| 7,094,125 | B2 * | 8/2006 | Kaneko et al. | 446/466 |
| 7,666,055 | B2 * | 2/2010 | Kim | 446/136 |
| 2001/0053653 | A1 | 12/2001 | Harada | |
| 2002/0094752 | A1 | 7/2002 | Kaneko et al. | |
| 2002/0123296 | A1 | 9/2002 | Tsang | |
| 2003/0104758 | A1 | 6/2003 | Tilbor et al. | |
| 2003/0201137 | A1 | 10/2003 | Crapo et al. | |
| 2004/0162002 | A1 | 8/2004 | Yoneda | |
| 2004/0198172 | A1 | 10/2004 | Kaneko et al. | |
| 2005/0250413 | A1 | 11/2005 | Lo et al. | |
| 2006/0217034 | A1 | 9/2006 | Kim | |

FOREIGN PATENT DOCUMENTS

| | | |
|---|---|---|
| EP | 307658 | 3/1989 |
| GB | 2201549 | 9/1988 |
| GB | 2386082 | 9/2003 |
| JP | 2005192621 | 7/2005 |

* cited by examiner

STEERING MECHANISM FOR A TOY VEHICLE

BACKGROUND OF THE INVENTION

The present invention relates to toy vehicles and, more particularly, to a steering mechanism for toy vehicles in which steering is accomplished by the application of an electromagnetic force.

Conventional toy vehicles employ a direction-converting device that includes a steering plate or link mounted on front wheels. The front wheels are turned left or right by reversible operation of a steering motor for converting the direction of the front wheels between a straight or neutral direction and a right direction or a left direction. Use of an electric steering motor requires further provision of a reduction gear train and at least one clutch to prevent damage to the motor. In addition, the steering motor itself is undesirably expensive in spite of the excellent control performance.

Therefore, it would be desirable to create a steering mechanism for a toy vehicle that avoids the above-described disadvantages of conventional direction-converting devices. Specifically, it would be desirable to create a steering mechanism for a toy vehicle that steers the toy vehicle directly, without the provision of a motor or gears or clutches. Further, it would be desirable to construct a steering mechanism that simply utilizes the attractive and/or repulsive forces between a magnet and an electric coil to rotate and/or change the direction of steerable road wheel or wheels of the toy vehicle.

BRIEF SUMMARY OF THE INVENTION

Briefly stated, in one aspect, the present invention is a steering mechanism A steering mechanism for a toy vehicle having a chassis with opposing right and left lateral sides and opposing front and rear ends and a plurality of road wheels coupled with the chassis so as to support the vehicle for itinerant movement across a surface, a turning member coupled with the chassis so as to pivot about the generally vertical axis, the turning member supporting at least one road wheel of the plurality on the chassis to rotate about a horizontal axis for movement of the vehicle on the at least one wheel and to pivot about the generally vertical axis for steerage of the vehicle. The steering mechanism comprises: a control member operably connected with the turning member and mounted for at least generally linear movement of the chassis; a magnetic body mounted on the chassis so as to pivot on a pivot axis extending in a generally horizontal direction on the chassis, the magnet body having a central axis at least generally perpendicular to the pivot axis and two opposite magnetic poles along the central axis at opposing distal ends of the magnetic body on opposite sides of said pivot axis; means for operably connecting the magnetic body with the control member and converting rotational movement of the magnetic body into at least generally linear motion of the control member; and coil means supported on the chassis so as to surround the magnetic body for rotating the magnetic body within the coil means by the passage of electric current in a selected direction through the coil means.

In another aspect, the invention is a steering mechanism for a toy vehicle having a chassis having opposing right and left sides and opposing front and rear ends, a right road wheel on said right side of said chassis and a left road wheel on said left side of said chassis, a right turning member pivotally mounted to said chassis steerably supporting the right road wheel on chassis and a left turning member pivotally mounted to said chassis steerably supporting the right road wheel. The steering mechanism comprises: a connecting member extending across said chassis in a width direction, said connecting member having a right end, a left end and a central portion therebetween, said right and left ends of said connecting member being operatively connected with said right and left turning members, respectively, the central portion including an elongated slot extending vertically to the connecting member; a magnetic body mounted onto said chassis to pivot on a pivot axis extending longitudinally front and rear in said vehicle; wherein said magnet body has a central axis at least generally perpendicular to said pivot axis and two opposite magnetic poles along the central axis at opposing distal ends of the magnetic body on opposite sides of said pivot axis; a crank on said pivot axis connected with said magnetic body to pivot with said magnetic body and operatively connected with said central portion to move said connecting member side to side on said vehicle; and coil means fixedly attached to said chassis so as to encircle said magnetic body for pivoting said magnetic body on said pivot axis and thereby pivot said right and left road wheels by passing a selected electric current through said coil means.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings four embodiments which are presently preferred. It should be understood, however, that the invention is not limited to the precise arrangements and instrumentalities shown.

In the drawings.

DETAILED DESCRIPTION OF THE INVENTION

Figure 1:
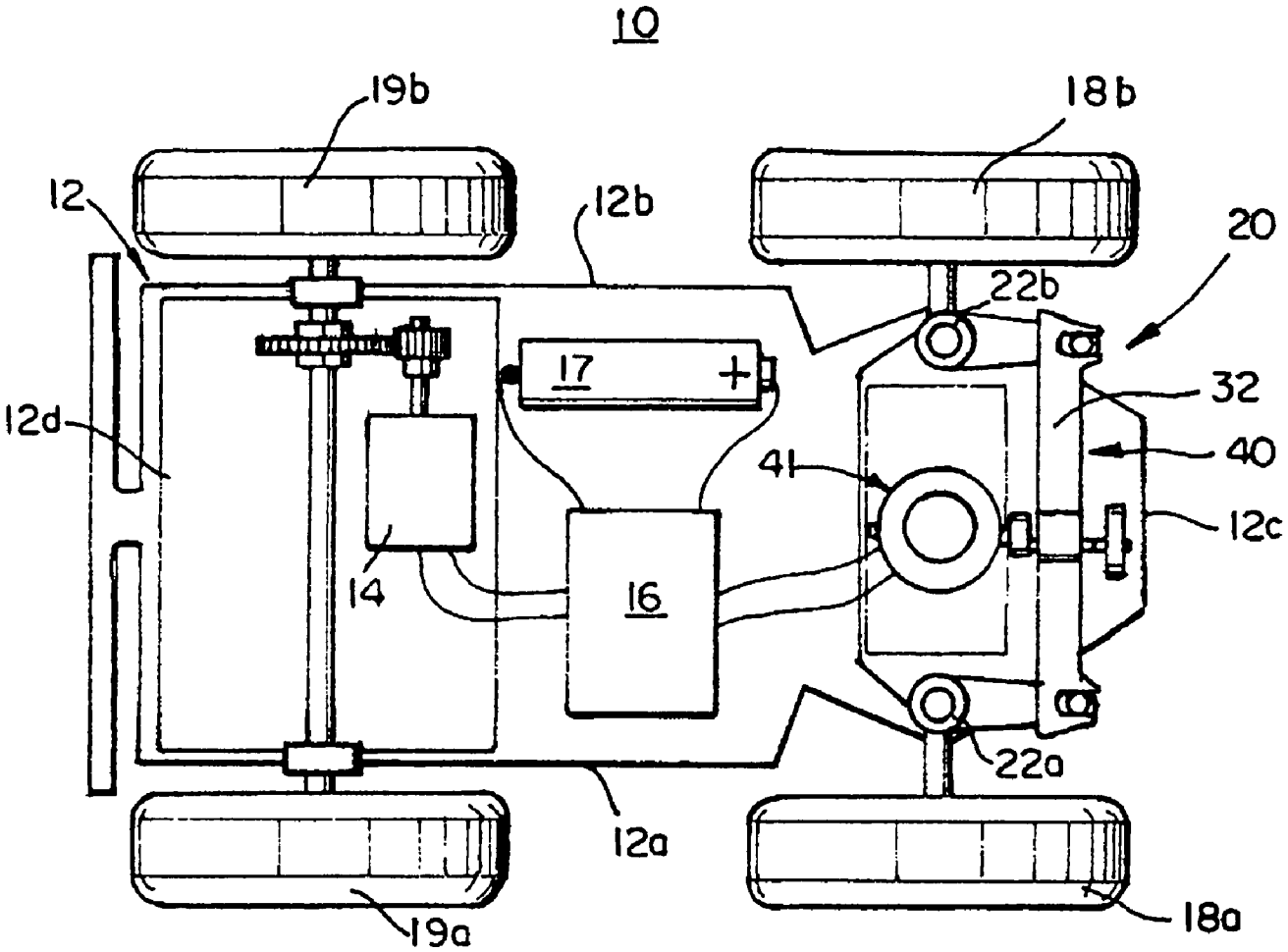
FIG. 1 is a top perspective view of a toy vehicle in accordance with a first preferred embodiment of the present invention, with a body cover of the vehicle removed for clarity and the steerable wheels and steering mechanism in a neutral, straight ahead steering configuration.

Certain terminology is used in the following description for convenience only and is not limiting. Unless otherwise indicated, the words "right," "left," "upper," and "lower" designate directions in the drawings to which reference is made. The terminology includes the words above specifically mentioned, derivatives thereof, and words of similar import.

Referring to the drawings in detail, wherein like numerals indicate like elements throughout, there is shown in FIGS. 1-7, a preferred embodiment steering mechanism of the present invention generally designated 20, for a toy vehicle, generally designated 10. Referring initially to FIG. 1, the toy vehicle 10 includes a chassis 12 with opposing right and left sides 12*a*, 12*b*, and opposing front and rear ends 12*c*, 12*d*, which reference numbers are also used to identify right and left sides and front and rear ends of the vehicle 10. According to the invention, a plurality of road wheels are coupled with the chassis 12 so as to support the vehicle 10 for itinerant movement across a surface, at least one of the road wheels being supported from the chassis to pivot about an at least generally vertical axis so as to steer the vehicle. In depicted toy vehicle 10 has right and left, preferably identical, steerable road wheels 18*a*, 18*b*, respectively, pivotally supported from the chassis 12 proximal one of the ends 12*c*, 12*d* of the toy vehicle 10 and chassis 12, a front end 12*c* in the depicted vehicle 10 so as to pivot about at least generally vertical axes. Further according to the invention, the toy vehicle 10 includes means to propel the vehicle 10 on the steerable road wheels 18*a*, 18*b*. Toy vehicles of the present invention may include at least drive wheel located proximal a remaining end of the toy vehicle 10 and chassis 12 to propel the toy vehicle. The depicted toy vehicle 10 preferably includes two identical, spaced apart, coaxially aligned drive wheels 19*a*, 19*b*, on opposite sides 12*a*, 12*b* of the vehicle 10 and chassis 12 proximal the rear end 12*d*, again as is typically found in the prior art. As is conventional, the toy vehicle 10 may also be provided with an electric propulsion motor 14 drivingly coupled with the drive wheels 19*a*, 19*b* and electronic control circuitry indicated diagrammatically at 16 for selectively connecting an electric power source 17 such as a battery pack or capacitor on the chassis 12 or rails under the chassis 12 running over electrified tracks (also not depicted) to the propulsion motor 14 and/or the steering mechanism 20.

Figure 2:
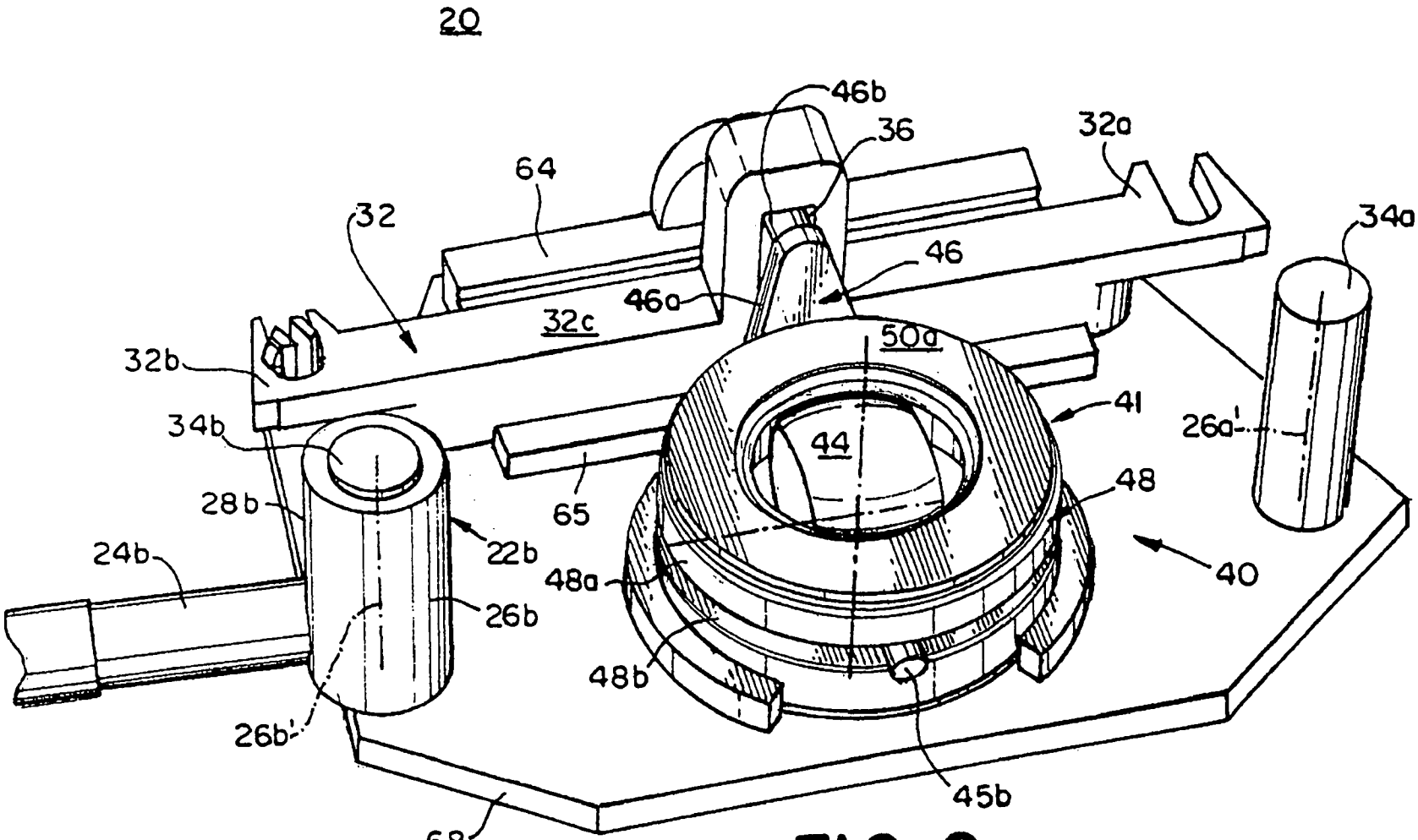
FIG. 2 is perspective view of a steering mechanism of the toy vehicle of FIG. 1 looking from slightly left of center at the top and rear of the mechanism oriented in a neutral or straight steering direction with the body cover of the vehicle, a front cover of the chassis, the road wheels and a right turning member removed for clarity.
Figure 3:
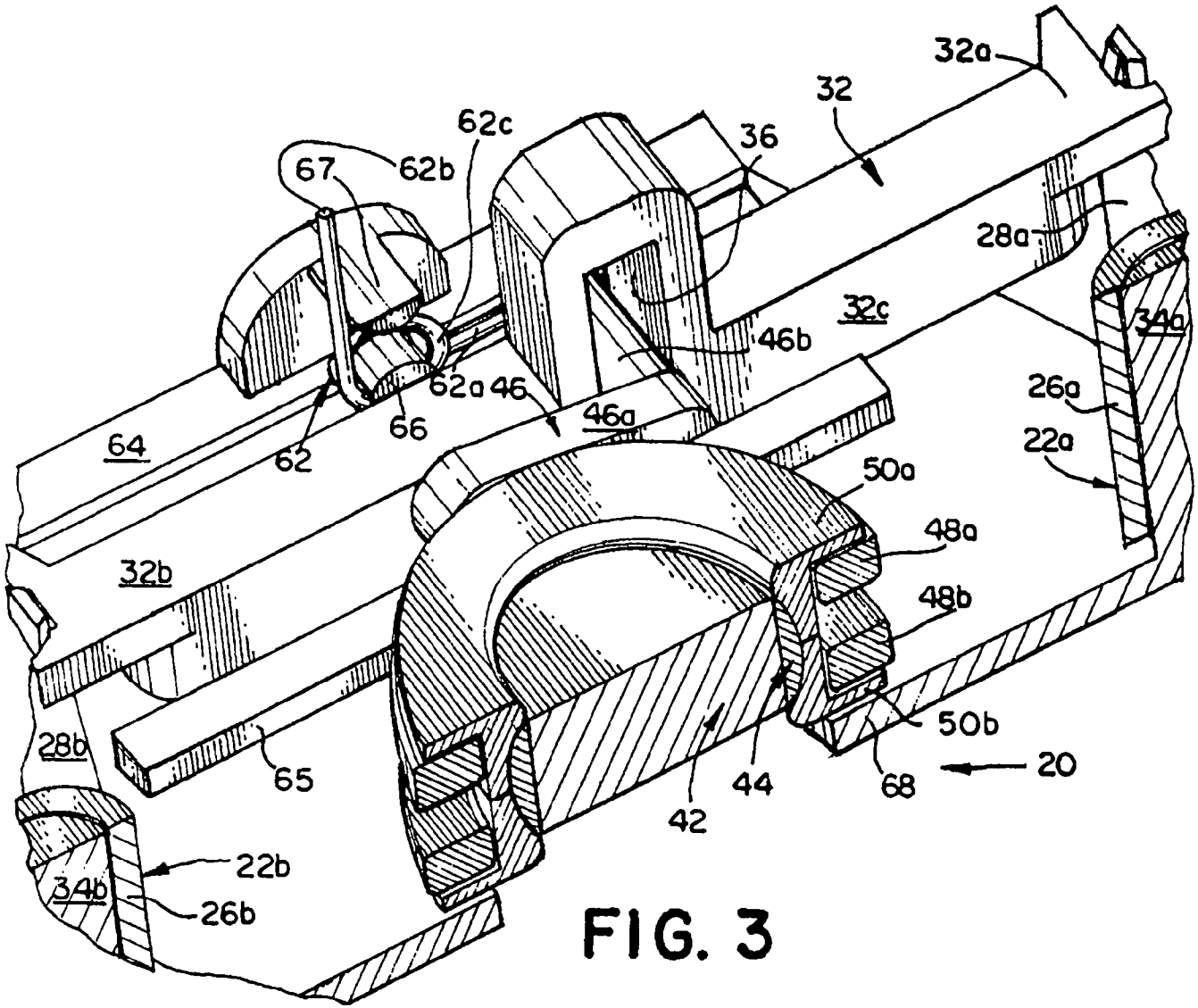
FIG. 3 is a top and rear perspective view of a steering mechanism of the foregoing figures looking from slightly left of center at the mechanism with the right side turning member fully pivoted in a right turn direction and partially sectioned along the line 3-3 in FIG. 2.
Figure 4:
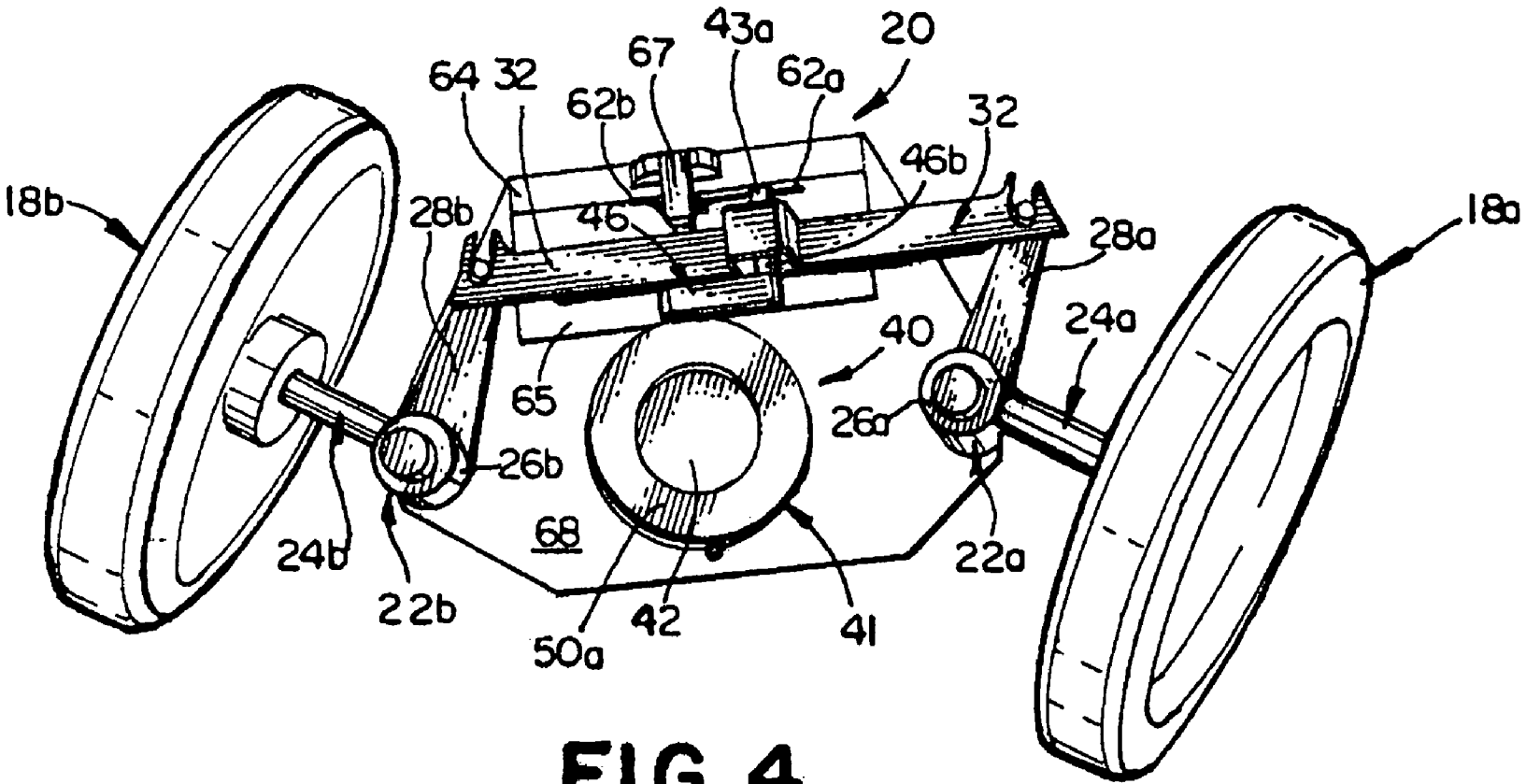
FIG. 4 is a top view of the steering mechanism of the foregoing figures in the right turn configuration of FIG. 3.
Figure 5:
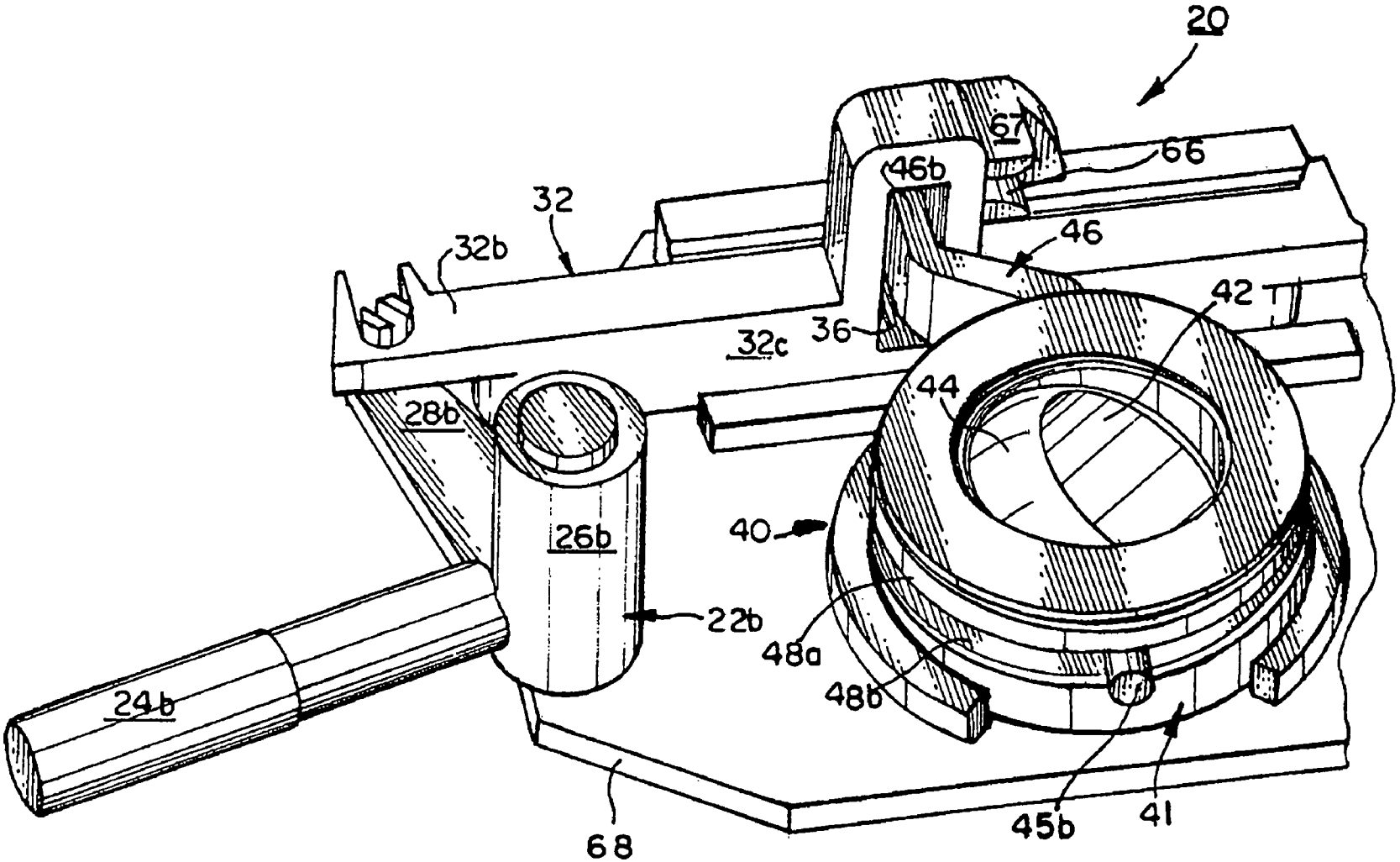
FIG. 5 is another perspective, view of the steering mechanism of the foregoing figures with the left side turning member partially pivoted in a left turn direction.
Figure 6:
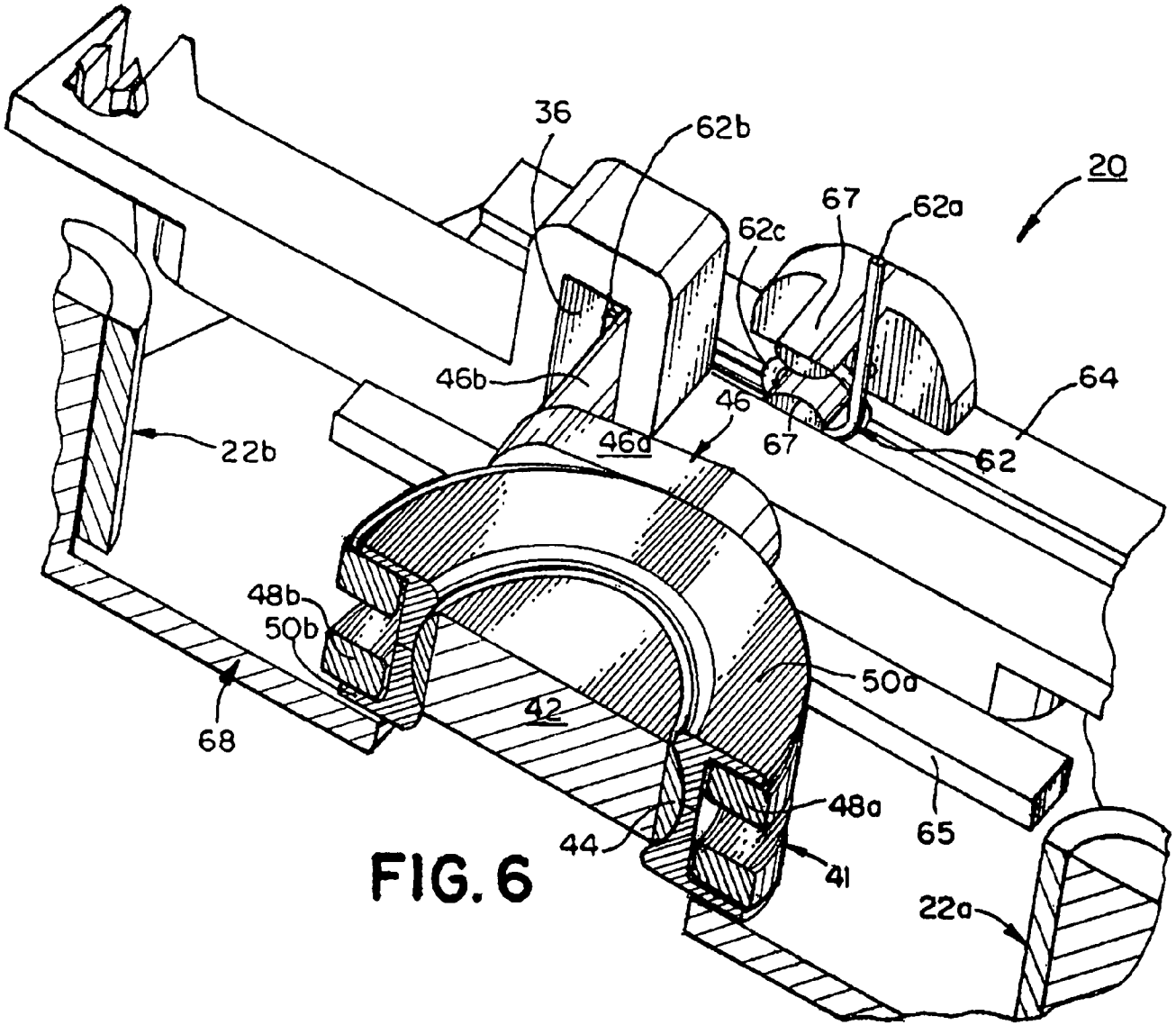
FIG. 6 is similar perspective view of the steering mechanism of the foregoing figures with the left side turning member fully pivoted in a left turn direction and partially sectioned along the lines 3-3 in FIG. 2.

Referring to FIGS. 2-7, the vehicle 10 further includes a right side turning member indicated at 22*a* and a preferably mirror image left side turning member indicated at 22*b*. Each of the right and left turning members 22*a*, 22*b* includes a stub axle 24*a*, 24*b*, respectively, extending outwardly from a main or central body 26*a*, 26*b*, respectively, to rotatably support the right and left steering road wheels 18*a*, 18*b*, respectively, for rotation about their respective central axes during movement of the toy vehicle 10 on a road or other support surface. The right and left turning members 22*a*, 22*b*, 24*b* are themselves pivotally mounted on the chassis 12 so as to steerably support the right and left road wheels 18*a*, 18*b* on the chassis 12. In particular, each central body 26*a*. 26*b* is respectively pivotally support on the chassis 12 to pivot about an at least generally vertical central axis, 26*a*', 26*b*', respectively (FIG. 2). Central bodies 26*a*, 26*b* may be tubular, as depicted, and be pivotally supported on vertical pins 34*a*, 34*b* fixedly located on the chassis 12. Alternatively, the central bodies 26 may be solid like king pins and be pivotally supported from the chassis in bearings or the like for pivotal movement about generally vertical axes (neither depicted). Each turning member 22*a*, 22*b* further includes a steering arm 28*a*, 28*b*, respectively, projecting outwardly from another side of the central body 26*a*, 26*b* spaced away from the stub shafts 24*a*, 24*b*, respectively.

The steering mechanism 20 includes a control member 32 extending in an at least generally horizontal direction, preferably a width direction across the chassis 12 between the right and left turning members 22*a*, 22*b*. More particularly, right and left ends 32*a*, 32*b*, respectively, of the control member 32 are operably pivotally connected with the right and left turning members 22*a*, 22*b* through the distal ends of each of the steering arms 28*a*, 28*b*, respectively. Control member 32 operably connects together the right and left turning members 22*a*, 22*b* for simultaneous steering movement of the right and left steerable road wheels 18*a*, 18*b*, respectively. The control member 32 further includes a central portion 32*c* between the ends 32*a*, 32*b* preferably configured for side to side sliding movement across the chassis 12, for example, in a slot defined between laterally extending, first and second structural members 64 and 65, respectively. The central portion 32*c* further includes an at least generally vertically extending opening 36 which is operably coupled with an actuator subassembly 40 of the steering mechanism.

Actuator subassembly (or simply "actuator") 40 preferably includes a solenoid indicated generally at 41 with an armature in the form of a magnetic body 42 mounted in a magnet housing 44 so as to pivot on a pivot axis 45' extending longitudinally front and rear along the chassis 12 in the vehicle 10. The magnetic body 42 includes a central axis 42' at least generally perpendicular to the pivot axis 45' (see FIG. 7). The two opposite magnetic poles N, S are generally centered along the central axis 42' at the opposing distal ends of the magnetic body 42 on opposite sides of the pivot axis 45'. While a single permanent magnet is preferred for providing the magnetic body 42, the magnetic body 42 may alternatively 6*e* provided by several stacked individual permanent magnets (not depicted). As can best be seen in FIGS. 6 and 7, the depicted magnetic body 42 is a cylinder and the magnet housing 44 is in the form of a sphere that is truncated on opposite sides 44*a*, 44*b* and that has a central bore 44*c* extending between the truncated sides to receive the magnetic body 42. The magnetic body 42 and magnet housing 44 may take other shapes and forms.

Figure 7:
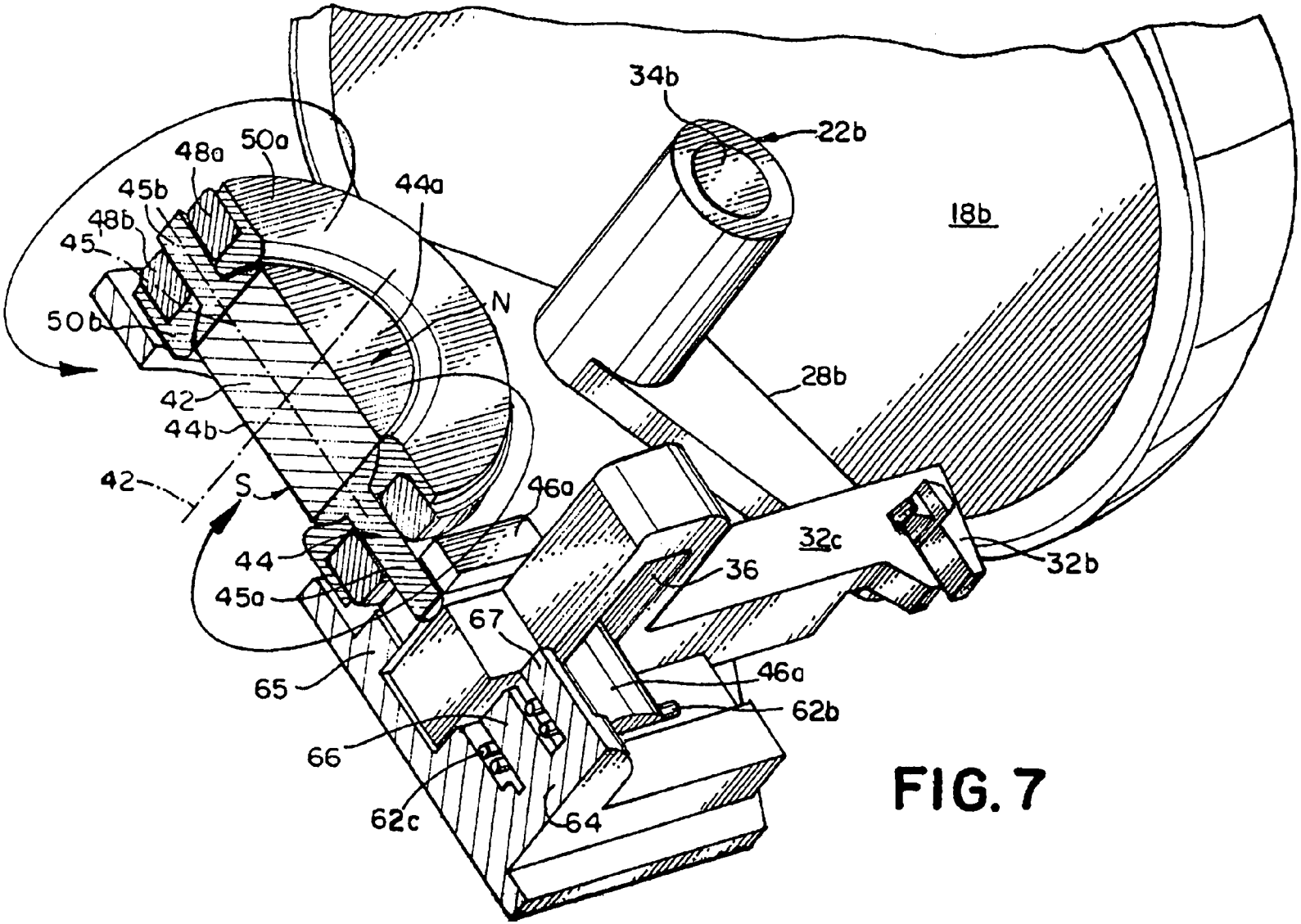
FIG. 7 is a perspective view of the steering mechanism of the foregoing figures looking at the left side of the mechanism partially sectioned along the lines 7-7 of FIG. 2 from the right side of the mechanism with the left side turning member fully pivoted in a left turn direction like FIG. 6.

The solenoid 41 of the actuator subassembly 40 further includes a stator with coil means preferably in the form of a single, electrically continuous coil 48 fixedly attached to the chassis 12 so as to encircle and surround the magnetic body 42 and magnet housing 44. Coil 48 is preferably physically divided into two electrically continuous, serially connected parts, more preferably at least essentially equal coil halves 48*a*, 48*b*, that are fixedly attached to the chassis 12 on opposite sides of the magnetic body 42, the magnet housing 44 and the pivot axis 45'. The coil halves 48*a*, 48*b* can be supported on the chassis 12 as shown, fixedly mounted on generally cylindrical, preferably identical, spool members 50*a*, 50*b*, respectively, that are themselves fixedly mounted to the chassis 12, oriented in mirror image facing positions on either side of stub shafts 45*a*, 45*b*. As is best seen in FIG. 7, stub shafts 45*a*, 45*b* extend from opposite sides of magnet housing 44, have central longitudinal axes (not individually depicted) that are coincident with pivot axis 45' and support the magnet housing 44 and magnetic body 42 for pivotal movement about the pivot axis 45' within the coil 48. Shafts 45*a*, 45*b*, extend between the coil halves 48*a*, 48*b* and through semicircular bearing openings provided in facing circumferential edges of the spool members 50*a*, 50*b*. Splitting one continuous coil in two on separate spool member 50*a*, 50*b* simplifies to fabrication of the actuator 40 with the magnetic body 42, and magnet housing 44 pivotally supported within the coil 48. While a single continuous coil physically separated into two halves is preferred, it will be appreciated that the coil means of the present invention is intended to include other, functionally equivalent coil arrangements including but not limited to two or more separate, stacked parallel connected coils and two or more separate coils separately and independently electrically powered by control circuitry on the toy vehicle.

Actuator subassembly 40 further means operably connecting the solenoid with the control member 32 for converting rotational movement of the solenoid into at least generally linear motion of the control member 32. Preferably, this means includes a crank 46 on the pivot axis 45' at the distal end of one of the stub shafts 45*a* most proximal to the control member 32. Crank 46 includes an arm 46*a* extending radially away from the central axis 45' and supporting a pin 46*b* eccentrically positioned generally parallel to but spaced radially from the pivot axis 45'. Pin 46*a* is movably received in the opening 36 in the control member 32 and converts rotational motion of the magnetic body 42 and magnet housing 44 into sliding movement of the control member 32. In this way, crank 46 is connected with the magnetic body 42 to pivot with the magnetic body 42 and operatively connected with the control member 32 to simultaneously move the control member 32 side to side on the chassis 12 and toy vehicle 10. In operation, an electric current is passed through the coil 48 in a selected direction and the magnetic body 42 and magnet housing 44 are pivoted about the pivot axis 45' and thereby pivot the right and left steerable road wheels 18*a*, 18*b* from the neutral, straight ahead steering configuration shown in FIG. 2 into right turn and left turn steering configurations shown in FIGS. 3-4 and 5-7, respectively.

The steering mechanism 20 further includes a centering subassembly indicated generally at 60. The purpose of the centering subassembly 60 is to return the actuator 40 and the right and left steerable road wheels 18*a*, 18*b* back to the neutral, straight ahead steering configuration shown in FIG. 2 with a lack of current flow through the coil 48 (i.e. when current is no longer passed through the coil 48). Centering subassembly 60 includes a bias member 62 fixedly coupled with the chassis 12 so as to maintains the control member 32 in the neutral position with a lack of current flow through the provided coil(s) 48. More particularly, bias member 62 is preferably a torsion spring with a central coil 62*c* and a pair of free arms 62*a*, 62*b* extending generally parallel to one another from opposite sides of the central coil 62*c*. Central coil 62*c* is fixedly coupled with the chassis 12 by being mounted on a projection such as a post 66 so as to at least partially surround the projection/post 66. Post 66 extends horizontally and longitudinally with respect to the chassis 12 from, and is fixedly coupled with the chassis 12 through the first structural member 64. A stop member 67 extends in the same direction generally in parallel with the post 66 from the first structural member 64 above the post 66. In the neutral, straight ahead steering configuration shown in FIG. 2, eccentric crank pin 46*a* extends over the post 66 and is in vertical alignment with the post 66 and stop 67. The free arms 62*a*, 62*b* extend upward from the central coil 62*c* on either lateral side of the stop 66 and the crank pin 46*a*. When the crank pin 46*a* is pivoted to the right or left side 12*a*, 12*b*, it contacts and biases one of the free arms 62*a*, 62*b*, respectively, in the same direction. Stop 65 resists similar movement of the remaining free arm 62*b*, 62*a*, thereby loading the spring 62. With a lack of current flow through the coil 48 (or other coil means), the biased spring arm 62*a* or 62*b* returns the crank pin 46*a* and thus the right and left steering road wheels 18*a*, 18*b* and the rest of the steering mechanism 20 back to the neutral, straight ahead steering configuration shown in FIG. 2.

The force applied to the magnetic body 42 is proportional to the change in inductance of the coil 48 with respect to the change in position of the magnetic body 42, and the current flowing through the coil. The force applied to the magnetic body 42 will always move the magnetic body 42 in a direction that increases the coil's inductance.

The magnetic field inside a solenoid is given by:

$$B = \mu_0 nI = \mu_0 \frac{NI}{h}$$

where $\mu_0 = 4\pi \times 10^{-7}$ henries per meter, B is the magnetic field magnitude in teslas, n is the number of turns per meter, I is the current in amperes, N is the number of turns and h is the length of the solenoid in meters.

This design is an improvement over prior designs. It is more effective because it generates more torque and requires less power to create it. Also it is less expensive because only one coil rather than two is required.

It will be appreciated by those skilled in the art that changes could be made to the embodiment described above without departing from the broad inventive concept thereof. For example, the relative positions of the various components of the steering mechanism can be rearranged. The connection member 32 could be located behind the solenoid instead of in front. The coil halves 48*a*, 48*b* can be located on the lateral sides 12*a*, 12*b* of the magnetic body 42 and magnet housing 44. The coil halves 48*a*, 48*b* and/or the stub shafts 45*a*, 45*b* can be supported by a housing or frame or other structural member(s) surrounding the armature.

While a preferred embodiment has been described controlling two vehicle road wheels, it will be appreciated that the steering mechanism of the present invention can be implemented in a vehicle having at least or only one steerably mounted road wheel. Both ends 32*a*, 32*b* of the control member 32 can be connected with steering arms extended from opposite lateral sides of a single steerable wheel, for example from opposite lateral sides of the center main shaft of a fork like that used in various types of cycles to rotatably support the road wheel for rotation about the transverse, horizontal central axis of the road wheel and pivotally mounted from the chassis to pivot the road wheel about a generally vertical axis to steer the vehicle. Indeed, only one end 32*a* or 32*b* of the connection member 32 need be provided pivotally coupled with a single steering arm from a steerable wheel.

While the structural components such as the first and second structural members 64 and 65 and the pins 34 can be fixed directly to or be formed (for example molded) as part of a chassis extending substantially the length of the toy vehicle between the front and rear ends, the steering mechanism and the steerable wheel(s) can be mounted on a platform member like one partially depicted at 68 in the FIGS. 2-7 and the platform 68 be mounted as a subassembly on one end of a toy vehicle. Alternatively, the structural member 64 supporting the post 66, stop 67 and spring 62 can be mounted to the chassis or platform so as to move or be moved in a lateral direction across the chassis on the chassis or platform so as to permit trim adjustment of the steering mechanism.

While a crank and slot are preferred for simplicity, it will be appreciated that other means for operably connecting the magnetic body and the control member and converting rotary motion of the magnetic body into linear motion of a control member, such as but not limited to rack and pinion or track and friction wheel, are considered functional though less desirable equivalents.

Toy vehicles utilizing the present invention can also be self controlled or remotely controlled. Self controlled vehicles have a power supply such as a battery or capacitor and control circuitry for selectively supplying electric current to the steering mechanism and any electric propulsion motor provided. The control circuitry typically includes a microprocessor and memory. Movement commands may be preloaded into memory for autonomous movement or sensors provided at various points on the vehicle to respond to contact with obstacles and automatically steer the vehicle away from contact. Movement commands may also be provided from a remote control by wired or wireless signals. Wireless control requires an antenna or other sensor on the vehicle to collect transmitted signals and a receiver to decode them for use by the microprocessor. Wired command signal may be sent directly to the microprocessor or supplied indirectly, for example through modulation of current supplied to power the vehicle in a conventional, electric road racing system.

It is understood, therefore, that this invention is not limited to the particular embodiments disclosed, but it is intended to cover modifications within the spirit and scope of the present invention as defined by the appended claim(s).

I claim:

1. A steering mechanism for a toy vehicle having a chassis having opposing right and left sides and opposing front and rear ends, a right road wheel on said right side of said chassis and a left road wheel on said left side of said chassis, a right turning member pivotally mounted to said chassis steerably supporting the right road wheel on chassis and a left turning member pivotally mounted to said chassis steerably supporting the left road wheel, said steering mechanism comprising:

a control member extending across said chassis in a width direction, said control member having a right end, a left end and a central portion therebetween, said right and left ends of said control member being operatively connected with said right and left turning members, respectively, said central portion including an elongated slot extending vertically to said control member;

a magnetic body mounted onto said chassis to pivot on a pivot axis extending longitudinally front and rear in said vehicle; wherein said magnet body has a central axis at least generally perpendicular to said pivot axis and two opposite magnetic poles along said central axis at opposing distal ends of said magnetic body on opposite sides of said pivot axis said magnetic body having an outer wall surrounding said central axis and distinct, opposing end walls extending transversely across said outer wall and the central axis, said magnetic body having a different magnetic pole at each of said opposing end walls, and said outer wall surrounding said central axis being cylindrical in shape;

said magnetic body being supported by a magnet housing pivotally mounted on said chassis and receiving said magnetic body to pivot the magnetic body about said pivot axis, the magnet housing being in the form of a sphere truncated proximal each of the ends of the magnetic body;

a crank on said pivot axis connected with said magnetic body to pivot with said magnetic body and operatively connected with said central portion to move said control member side to side on said vehicle; and coil means fixedly attached to said chassis so as to encircle said magnetic body for pivoting said magnetic body on said pivot axis and thereby pivot said right and left road wheels by passing a selected electric current through said coil means.

2. The steering mechanism of claim 1 wherein the crank has a crank arm connected with the magnet housing at one end to pivot with the magnetic body on the pivot axis and a crank pin at an opposite end received in the elongated slot in the control member such that pivotal movement of the magnetic body about the pivot axis is converted to linear horizontal movement of the control member and to pivotal movement of the right and left road wheels.

3. The steering mechanism of claim 2 further comprising a centering subassembly operating on the crank arm so as to return the control member to a neutral, straight ahead steering configuration with a lack of current flow through the coil means.

4. The steering mechanism of claim 3 wherein the centering subassembly includes a torsion coil spring with a pair of free arms which extend past opposite sides of the crank pin with the control member in a neutral, straight ahead steering configuration.

5. The steering mechanism of claim 1 further comprising a bias member coupled with the chassis so as to maintain said control member a neutral position with a lack of current flow through the coil means.

6. The steering mechanism of claim 5 wherein said bias member is a torsional spring operably connected with said crank.

7. The steering mechanism of claim 1 wherein said coil means is a single, electrically continuous coil.

8. The steering mechanism of claim 7 where said single coil is broken into first and second electrically connected coil parts, said first and second coil parts being positioned in a spaced-apart relation on said chassis on opposite sides of said pivot axis.

9. The steering mechanism of claim 1 further comprising a torsional spring bias member operably connected between the crank and the chassis so as to maintain the control member in a neutral position with a lack of current flow through the coil means, the torsional spring bias member including a pair of free arms which extend from an attachment to the chassis along and past opposite sides of a pin of the crank with the control member in a neutral, straight ahead steering configuration.

10. The steering mechanism of claim 1 further comprising a slot on the chassis extending elongatedly in the width direction and receiving the control member for linear movement across the chassis.

11. A steering mechanism for a toy vehicle having a chassis with opposing right and left sides and opposing front and rear ends extending across a width direction of the chassis between the right and left sides, a right road wheel proximal the right side of the chassis and a left road wheel proximal the left side of the chassis, a right turning member pivotally mounted to the chassis steerably supporting the right road wheel on the chassis and a left turning member pivotally mounted to the chassis steerably supporting the right road wheel on the chassis, the steering mechanism comprising:

a control member extending elongatedly in the width direction entirely across the chassis, the control member having a right end, a left end and a central portion therebetween, the right and left ends of the control member being directly engaged with the right and left turning members, respectively, and the central portion including a vertically elongated opening;

a magnetic body of a cylindrical shape and having a central axis, an outer wall surrounding the central axis and extending in a direction of the central axis, and two distal ends distinct from the outer wall and extending across the central axis at opposite ends of the outer wall, the magnetic body having a different magnetic pole at each of the two distal ends;

a magnet holder mounted on the chassis to pivot on a pivot axis extending longitudinally front and rear on the chassis, the magnet holder supporting the magnetic body to pivot the magnetic body on the pivot axis with the central axis of the magnetic body perpendicular to the pivot axis, the magnet holder being in the form of a sphere truncated proximal each of the distal ends of the cylindrical shape of the magnetic body;

a crank arm extending transversely from the pivot axis and connected with the magnet holder so as to pivot with the magnet holder and the magnetic body on the pivot axis;

a crank pin extending transversely from the crank arm and into the elongated vertical opening of the central portion so as to operatively connect the magnetic body with the control member to move the control member side to side on the chassis;

coil means mounted on the chassis so as to encircle the magnetic body and the magnet holder and pivot the magnetic body and magnet holder on the pivot axis and thereby pivot the right and left road wheels by passage of a select electric current through the coil means; and a torsional spring member operably connected between the crank pin and the chassis so as to maintains the control member a neutral straight ahead steering configuration with a lack of current flow through the coil means, the torsional spring member having one end connected with the chassis and including a pair of free arms extending away from the one end along and past opposite sides of the crank pin at least with the control member in the neutral, straight ahead steering configuration.

12. The steering mechanism of claim 11 wherein the coil means is a single, electrically continuous coil.

13. The steering mechanism of claim 12 wherein the single coil is split into two separated halves positioned on opposite sides of the pivot axis of the magnetic body.

14. The steering mechanism of claim 11 wherein the control member is positioned for sliding linear movement in a slot extending in the width direction on the chassis.

* * * * *